United States Patent [19]

Webinger

[11] 4,260,101

[45] Apr. 7, 1981

[54] EXPANDABLE CONTAINER AND BLANK THEREFOR

[75] Inventor: George P. Webinger, Minneapolis, Minn.

[73] Assignee: Champion International Corporation, Stamford, Conn.

[21] Appl. No.: 44,942

[22] Filed: Jun. 4, 1979

[51] Int. Cl.[3] ..... B65D 85/70

[52] U.S. Cl. ..... 229/41 C; 229/39 R; 426/111

[58] Field of Search ..... 150/42; 229/39 R, 41 C, 229/37 R, 23 BT; 426/111, 107, 234

[56] References Cited

U.S. PATENT DOCUMENTS

| | | | |
|---|---|---|---|
| 527,202 | 10/1894 | Heywood et al. | 150/42 X |
| 727,723 | 5/1903 | Webb | 229/39 R X |
| 2,013,691 | 9/1935 | Martinson | 229/41 C UX |
| 2,044,103 | 6/1936 | Rossi | 229/41 C UX |
| 2,047,804 | 7/1936 | Shapiro | 229/41 C UX |
| 2,886,231 | 5/1959 | Benzon-Peterson | 229/37 R X |
| 4,134,531 | 1/1979 | Martinez et al. | 229/23 BT |

*Primary Examiner*—Davis T. Moorhead
*Attorney, Agent, or Firm*—Evelyn M. Sommer

[57] ABSTRACT

An expandable container, formed of a unitary blank of paperboard, including a planar base panel and a plurality of planar fins foldable over the panel to enclose a conical volume. The fins serially overlap and are self-locking in the closed position, and are expandable into the open position by a force exerted from the inside thereof. Such a force can be provided by the popping of corn kernels located therein when the container is heated in a microwave oven. The fins each are trapezoidal in shape, have an interior fold line separating each into a triangular area and a parallelogram shaped area, and are hingedly coupled to the next two adjacent fins.

7 Claims, 6 Drawing Figures

EXPANDABLE CONTAINER AND BLANK THEREFOR

FIELD OF THE INVENTION

The present invention relates to an expandable container formed from a unitary blank of paperboard. More particularly, the invention relates to an expandable container which can be utilized in a microwave oven for the popping of popcorn. The blank includes a polygonal base panel and a plurality of fins foldable over the panel to enclose the corn kernels therein.

BACKGROUND OF THE INVENTION

Before the widespread use of microwave ovens, a typical container for popcorn making comprised a metal pan with a handle for supporting the corn kernels and suitable oils therein with an expandable thin metal sheet covering the pan. This pan was placed over a burner, thereby heating the corn kernels and oil, popping the kernels and forming the expanded popcorn. The expanded popcorn also expanded the thin metal sheet.

With the widespread use of microwave ovens, this type of packaging is inadequate since the metal pan and sheet insulate microwave energy and cannot thereby be used inside a microwave oven. In order to provide a package for use in a microwave oven, there has been proposed a paperboard expandable package as disclosed in U.S. Pat. No. 4,036,423, issued to R. L. Gordon. However, the package of the Gordon patent requires the application of adhesive to form the container for the kernels, which is time consuming and expensive to manufacture. In addition, it requires adhesive to lock the package in the closed position, which is also time consuming and expensive to manufacture. Moreover, this prior art package involves the folding of a plurality of flaps, on top of one another, which are then difficult to open during expansion of the popcorn therein.

SUMMARY OF THE INVENTION

Accordingly, it is an object of the present invention to provide an expandable container for use in a microwave oven for the popping of corn kernels which is cheaply and quickly manufactured.

Another object of the present invention is to provide an expandable container from a unitary blank of paperboard which can be used in a microwave oven for the popping of corn kernels and which requires no adhesive to form the container and no adhesive to lock the container closed.

Another object of the present invention is to provide an expandable container formed from a unitary blank of paperboard which is self-locking in the closed position and which can be expanded reliably and easily into an open position by means of a force exerted from the inside thereof, such as by the expansion of popping corn kernels.

Another object of the present invention is to provide an expandable container formed from a unitary blank of paperboard which is highly attractive, resembling the form of a flower.

Another object of the present invention is to provide an expandable container which can serve as a storage container, a heating container and a serving container for materials such as popcorn which are heated in a microwave oven.

The foregoing objects are basically attained by providing an expandable container formed from a unitary blank for enclosing an expandable food, the combination comprising a polyagonal base panel adapted to support the food thereon; and self-locking, expandable means, hingedly extending along fold lines from the sides of the base panel, for enclosing a volume above the base panel; the self-locking, expandable means including a plurality of fins, one associated with each side of the base panel, each of the fins hingedly coupled to the two adjacent fins on opposed sides thereof along fold lines, and each of said fins having an interior fold line therein; said fins in a closed position enclosing the volume by being folded into a position overlying the base panel by folding the fins inwardly over the base panel so that all of the interior fold lines intersect substantially at one point spaced above the base panel and in which a portion of each fin overlaps a portion of the next adjacent fin; the fins being outwardly expandable into an open position upon expansion of the food supported on the base panel.

Since the container is formed from a unitary blank and needs no adhesive to form the container or to close the container, the container of the present invention is quickly and cheaply manufactured and is self-locking. In addition, the overlapping fins provide a configuration to the container similar to a flower which is highly attractive and is reliably and easily opened upon the popping of the corn kernels supported inside. Moreover, this container can be used in a microwave oven for heating of the corn kernels and can also be used to serve the ultimately popped popcorn.

Other objects, advantages and salient features of the present invention will become apparent from the following detailed description, which, taken in conjunction with the annexed drawings, discloses a preferred embodiment of the present invention.

DESCRIPTION OF THE DRAWINGS

Referring now to the drawings which form a part of this original disclosure.

DETAILED DESCRIPTION OF THE INVENTION

Figure 1:
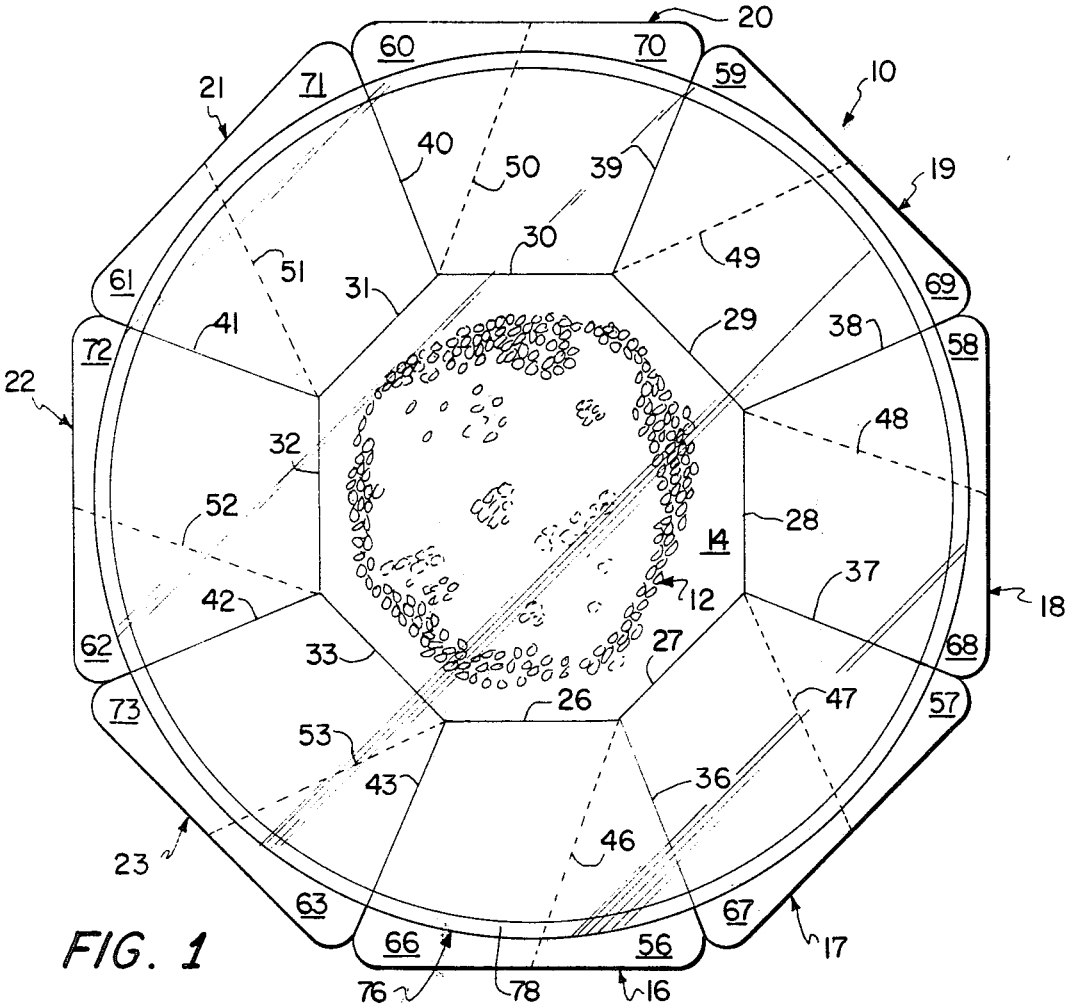
FIG. 1 is a top plan view of the blank in accordance with the present invention having corn kernels and oil mixed therein supported on the base panel and covered by a thin sheet which is secured to the plurality of fins coupled to the base panel, in which the container so formed is in the fully opened position.

Referring now to FIG. 1, the unitary blank 10 in accordance with the present invention is shown formed of paperboard or similar foldable material which can be treated as necessary to adequately maintain the corn kernels and oil 12 therein once the container is placed and heated in a microwave oven.

As seen in FIG. 1, the blank 10 is comprised of a planar, octagonal base panel 14 surrounded by a continuous annular series of trapezoidal shaped, planar fins 16, 17, 18, 19, 20, 21, 22, and 23. As shown, the base panel 14 has eight sides; however, it need not have that many sides as long as it is polyagonal. In all events, there is one fin associated with each side of the base panel.

Each of the fins 16–23 hingedly extends along one of the fold lines 26–33 from the sides of the base panel 14. In addition, each of the fins is hingedly coupled to the two adjacent fins on opposed sides thereof along respective fold lines 36–43. Thus, the combination of the base panel ad the eight fins form a continuous, uninterrupted surface which, as seen in FIG. 1, is flat. Each of the fins is trapezoidal in shape as seen in FIG. 1 and has its smaller base coincident with the respective fold lines between the fin and the base panel 14.

An interior fold line is located in each of the fins and extends between the exterior edge of each fin, which is the longer base of the trapezoidally shaped fin, and the intersection of the fold line between the fin and the base panel and one of the fold lines between the fin and the two adjacent fins. These interior fold lines are designated 46–53 for the respective fins 16–23.

As seen in FIG. 1, each of these interior fold lines separates each trapezoidal fin into a triangular area and a parallelogram shaped area. These triangular areas are designated by character numerals 56–63 respectively for each of the fins 16–23 and the parallelogram shaped areas are designated by character numerals 66–73 respectively for each of the fins 16–23.

To enclose the kernels and oil 12 onto the blank 10 a film of sheet material 76, having a circular outer periphery, is placed over the kernels and oil 12 and also over each of the fins. At its outer periphery, the film 76 is adhered by a continuous circular strip of adhesive 78 to the fins. Rather than a continuous strip of adhesive, the adhesive may be applied merely in spots. Alternately, the film 76 can be in the form of a closed bag enclosing the kernels and oil, in which case it is merely supported on the base panel 14 and not adhered to the fins.

Advantageously, each of the interior fold lines 46–53 has a length greater than one-half the distance between the opposed corners of the base panel 14, these corners being defined by the intersection of adjacent fold lines 26–33. In other words, upon folding, the extent of the fins along the interior fold line will be greater than one-half the distance between the opposed corners of the base panel. This will provide an enclosed volume in conical shape in which the corn kernels and oil reside. Accordingly, upon folding of the fins and closing of the container, there will be a volume provided for the kernels and oil and the container will not be substantially flat, but instead will be substantially conical.

In this regard, as will be described in more detail hereinafter, the plurality of fins provide a self-locking feature to the container and being formed of somewhat rigid paperboard provide a strong outer enclosure for the kernels and oil, resisting a downward force tending to crush the container.

Figure 2:
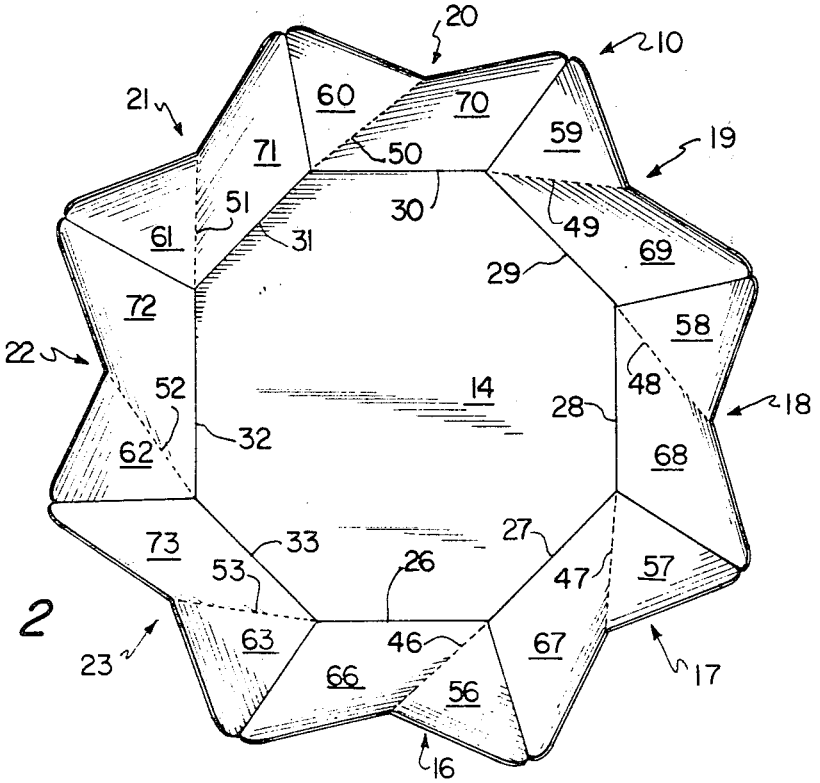
FIG. 2 is a top plan view of the container shown in FIG. 1, with the sheet and kernels deleted for clarity, the fins having been partially folded out of the plane of the base panel shown in FIG. 1 to a position in which they are substantially midway along their pivoting motion towards closing of the container.
Figure 3:
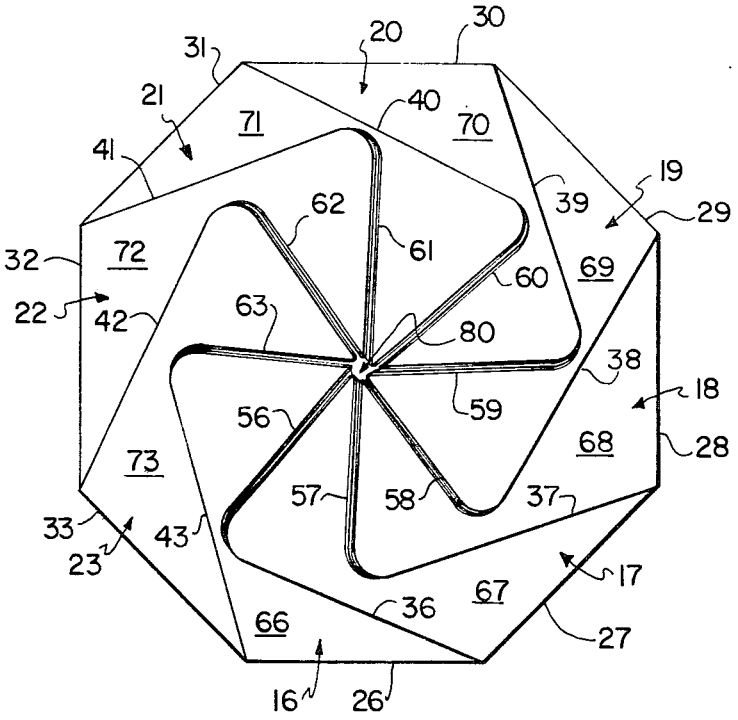
FIG. 3 is a top plan view of the container shown in FIG. 2 in which the fins are in their completely closed position.
Figure 4:
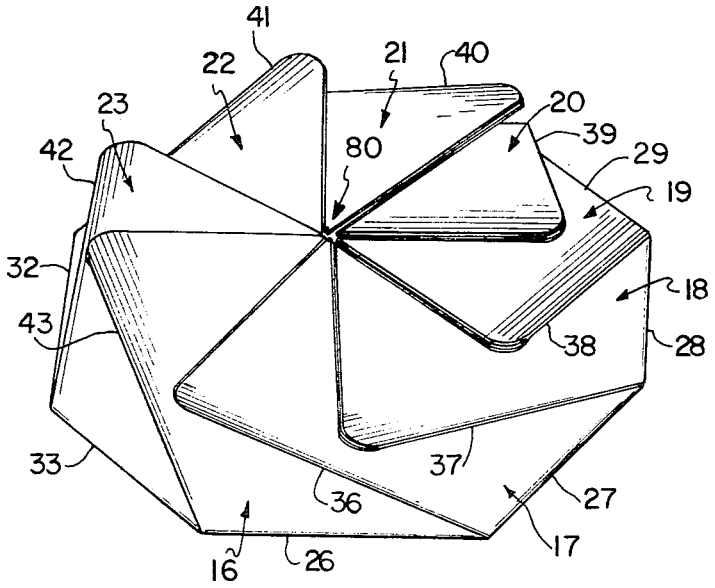
FIG. 4 is a perspective view of the closed container shown in FIG. 3.

Referring now to FIG. 2, which shows the blank without the film 76 and kernels and oil 12 for reasons of clarity, it is seen that the blank 10 can easily be folded so as to enclose a volume above the panel 14. In order to accomplish this, the various fins are folded inwardly to a position overlying the base panel 14 along fold lines 26–33 connecting each fin with the base panel. In addition, each of the fins is folded along its interior fold line so that the outer surface of each triangular area therein tends to overlap the outer surface of each parallelogram shaped area therein. Also, each of the fins is folded along the fold lines between adjacent fins so that the interior surface of the triangular area on one fin contacts the interior surface of the parallelogram shaped area on the next adjacent fin. This folding is continued from the position shown in FIG. 2 until all of the fins have been suitably folded in series so that a portion of each fin overlaps a portion of the next adjacent fin and all of the interior fold lines in the fins intersect substantially at one point 80 spaced above the base panel 14, as shown in FIGS. 3 and 4. In this configuration, the closed container somewhat resembles a flower and is particularly attractive. In addition, in this configuration, the plurality of now folded fins defines the conical volume inside the container between these folded fins and the base panel 14. In the position shown in FIGS. 3 and 4, the fins are in a self-locking configuration because of the manner in which they are folded and overlapped and tend to remain in that closed position unless an outwardly acting force is exerted thereon. In addition, these overlapped fins provide significant rigidity to the container resisting a downward force against the fins. During the folding operation, the film 76 tends to be folded along the fold lines in the blank 10.

Figure 5:
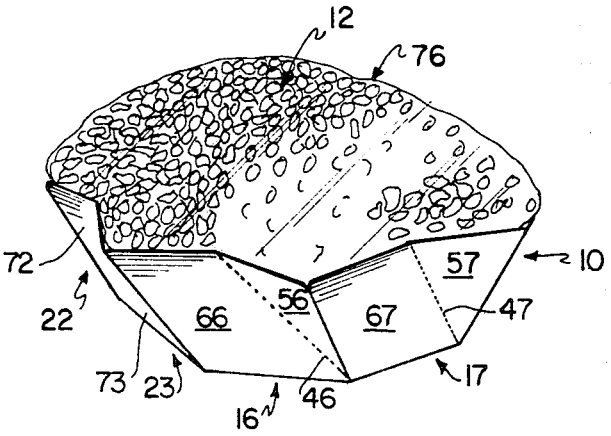
FIG. 5 is a perspective view of the opened container in accordance with the present invention in which the corn kernels have been fully popped and the sheet and container have been fully expanded into the opened position by the expansion of the popcorn.

Once the container is placed in its closed position and has corn kernels and oil therein, it is extremely easy to use for making popcorn in a microwave oven. All that is necessary is to place the container into the oven and actuate the oven as necessary. During the heating operation, the kernels and oil combine to pop the corn, thereby expanding the volume of each kernel. As more and more of the kernels are so expanded, they tend to push outwardly on the folded fins of the container as well as against the film 76 located therein. This force tends to force the overlapped fins outwardly about fold lines 26–33 and this force continues to act on these fins reversing the steps taken to close the fins. Ultimately, the expanding popcorn completely opens the container by pushing the fins outwardly and unfolding the fins relative to the base panel and relative to one another, including an unfolding of the various triangular and parallelogram shaped areas formed by the interior fold lines. This unfolded position is shown in FIG. 5 in which the heated kernels and oil have combined to pop the kernels and this expansion of the kernels has fully expanded the fins as well as the film 76. In this configuration, the container also acts as a serving bowl for the popcorn, so that an additional utensil or bowl is not necessary.

Figure 6:
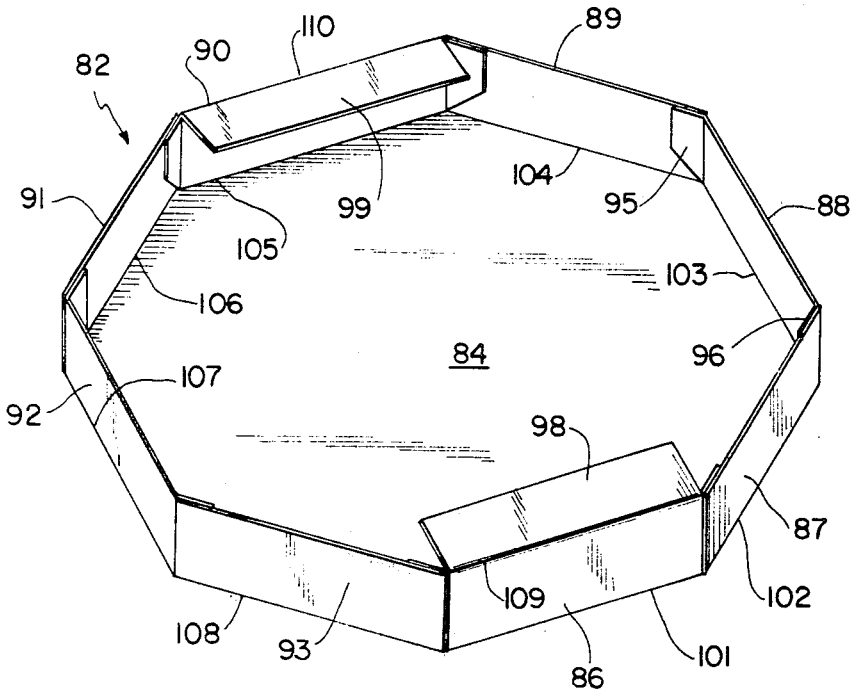
FIG. 6 is a perspective view of a cover for the container.

In order to provide improved stackability of the container in accordance with the present invention, a cover 82 as seen in FIG. 6 is provided which has the same geometric shape as the container 10, in this case having an octagonal shape in plan view.

This cover 82 comprises an octagonal top panel 84 having eight rectangularly shaped side flaps 86–93 hingedly extending along each of the sides along fold lines 101–108. Alternate side flaps 86, 88, 90, and 92 have tabs 95 and 96 on opposite sides so as to provide a connection by means of adhesive with the adjacent two side flaps. In the erected position, side flaps 86–93 are perpendicular to the top panel 84.

In addition, side flaps 86 and 90 have hingedly connected at the tops thereof along respective fold lines 109 and 110 two closure flaps 98 and 99 which are also rectangular and are parallel to the top panel.

In use, advantageously the cover 82 is maneuvered on top of the closed container so that the bottom of top panel 84 is supported on the top of the folded fins and so that closure flaps 98 and 99 are received on the bottom of the base panel 14 of the container. Suitable adhesive can be applied between the bottom of the base panel 14 and the closure flaps 98 and 99 to secure them together. This provides a very advantageous stackability to the container 10 while it is being shipped or stored. This cover is removed from the container prior to insertion of the container into the microwave oven.

While only two closure flaps are shown extending from the cover, there could be more of these utilized. Alternately, these flaps can be eliminated, with the cover and container being enclosed in a separate overwrap, such as a shrink film.

While one advantageous embodiment has been chosen to illustrate the invention, it will be understood by those skilled in the art that various changes and modifications can be made therein without departing from the scope of the invention as defined in the appended claims.

What is claimed is:

1. An expandable container formed from a unitary paperboard blank without an adhesive seam for enclosing popcorn to be cooked in a microwave oven, the combination comprising:

a polygonal paperboard base panel adapted to support the popcorn thereon; and self-locking, expandable means, hingedly extending along fold lines from the sides of said base panel, for enclosing a volume above said base panel, said self-locking, expandable means including a plurality of paperboard fins, one hingedly connected by means of a common fold line with each side of said polygonal base panel, each of said fins also being hingedly coupled to the two adjacent fins on opposed sides thereof along fold lines, and each of said fins having an interior fold line therein, said fins in a closed position enclosing the volume by being folded into a position overlying said base panel by folding said fins inwardly over said base panel so that all of said interior fold lines intersect substantially at one point spaced above said base panel and in which a portion of each fin overlying a portion of the next adjacent fin, said fins being outwardly expandable into an open position upon expansion of the food supported on said base panel.

2. A container according to claim 1, wherein each of said fins has a trapezoidal shape.

3. A container according to claim 1, wherein each of said interior fold lines divides each of said fins into a triangular area and a parallelogram shaped area.

4. A container according to claim 3, wherein each of said fins, in the closed position, has the triangular area therein overlapping the parallelogram shaped area therein, thereby locking said fins in the closed position.

5. A container according to claim 1, and further comprising a film coupled to said fins for enclosing the popcorn supported on said base panel.

6. A container according to claim 1, and further comprising a cover receivable over said fins in the closed position, said cover having the same geometric shape as said base panel.

7. A container according to claim 1, wherein each of said interior fold lines has a length greater than one-half the distance between opposed corners of said polygonal base panel, thereby defining a substantially conical volume inside said container.

* * * * *